US010370846B1

(12) United States Patent
Neuwirt

(10) Patent No.: US 10,370,846 B1
(45) Date of Patent: Aug. 6, 2019

(54) FRAMED WALL INSULATION BACKING DEVICE, AND RELATED SYSTEMS AND METHODS

(71) Applicant: George M. Neuwirt, Sunapee, NH (US)

(72) Inventor: George M. Neuwirt, Sunapee, NH (US)

( * ) Notice: Subject to any disclaimer, the term of this patent is extended or adjusted under 35 U.S.C. 154(b) by 0 days.

(21) Appl. No.: 15/890,993

(22) Filed: Feb. 7, 2018

Related U.S. Application Data

(60) Provisional application No. 62/456,461, filed on Feb. 8, 2017.

(51) Int. Cl.

| | |
|---|---|
| ***E04B 1/76*** | (2006.01) |
| ***E04B 1/00*** | (2006.01) |
| ***E04B 1/41*** | (2006.01) |
| ***E04B 1/38*** | (2006.01) |

(52) U.S. Cl.
CPC ..... *E04B 1/7654* (2013.01); *E04B 1/0007* (2013.01); *E04B 1/40* (2013.01); *E04B 2001/405* (2013.01)

(58) Field of Classification Search
CPC ..... E04B 1/7654; E04B 1/40; E04B 1/0007; E04B 2001/405; E04B 1/7666; E04F 13/0801; E04F 13/0805; E04F 13/0808; E04D 3/3602
See application file for complete search history.

(56) References Cited

U.S. PATENT DOCUMENTS

| | | | | | |
|---|---|---|---|---|---|
| 1,140,687 | A * | 5/1915 | Lane | E04F 13/0801 | 411/461 |
| 1,373,036 | A * | 3/1921 | Upson | E04F 13/0837 | 411/466 |
| 1,535,220 | A | 4/1925 | Gallagher | | |
| 1,691,179 | A * | 11/1928 | Betz | E04F 19/06 | 52/282.4 |
| 2,282,631 | A * | 5/1942 | Winship | E04B 2/58 | 248/217.3 |
| 2,386,887 | A | 10/1945 | Eckel | 85/11 | |
| 2,580,231 | A | 12/1951 | Lamm | 248/300 | |
| 2,586,388 | A * | 2/1952 | Schafroth | E04B 1/40 | 24/703.5 |
| 2,880,481 | A * | 4/1959 | Robinson, Jr. | E04F 13/085 | 52/489.2 |
| 3,020,602 | A * | 2/1962 | Siering | E04F 13/0816 | 411/458 |
| 3,218,771 | A * | 11/1965 | Horn | E04F 13/0805 | 52/404.1 |
| 3,231,944 | A | 2/1966 | Bennett | 52/406 | |

(Continued)

*Primary Examiner* — Rodney Mintz
(74) *Attorney, Agent, or Firm* — Hayes Soloway P.C.

(57) ABSTRACT

A framed wall insulation backing apparatus has a substantially planar backing panel. At least one attachment leg is extending from the backing panel, wherein the at least one attachment leg is positioned in a substantially perpendicular direction from a plane of the backing panel. At least one insulation-retention device formed on the backing panel, wherein the at least one insulation-retention device is positionable to extend away from a planar face of the backing panel. The apparatus may be used with a framed wall, positioned a spaced distance from a concrete wall, to maintain a spaced distance between insulation batts of the framed wall and the concrete wall.

17 Claims, 12 Drawing Sheets

(56) References Cited

U.S. PATENT DOCUMENTS 3,377,760 A 4/1968 Waite ..... 52/410
3,741,068 A * 6/1973 Andruskiewicz ... E04F 13/0837 403/401
4,000,596 A * 1/1977 Magill ..... E04B 2/7457 52/481.2
4,069,636 A 1/1978 Kessler ..... 52/712
4,111,096 A 9/1978 Fasth ..... 85/11
4,139,975 A 2/1979 Baker ..... 52/506
4,292,777 A 10/1981 Story ..... 52/407
4,359,849 A * 11/1982 Goeman ..... E04F 13/0801 52/309.4
4,389,190 A 6/1983 Sevink ..... 432/247
4,471,592 A 9/1984 MacKinnon, Jr. et al. .... 52/404
4,512,130 A 4/1985 Pepin ..... 52/404
4,545,103 A * 10/1985 Bryant ..... E04D 3/3602 29/432
4,621,473 A * 11/1986 Wendt ..... E04F 13/0823 52/361
4,653,241 A 3/1987 Bindi ..... 52/169.11
4,736,917 A 4/1988 Thuresson ..... 248/205.3
4,761,928 A 8/1988 Pichette ..... 52/404
4,862,667 A * 9/1989 Melland ..... E04C 3/292 52/847
4,918,893 A 4/1990 Vandenbroucke et al. ..... 52/404
5,060,441 A 10/1991 Pichette ..... 52/404
6,209,277 B1 * 4/2001 DiGate ..... E04F 13/0841 52/514
6,487,825 B1 12/2002 Sillik ..... 52/404.1
6,622,448 B1 9/2003 Sonne ..... 52/656.1
7,104,018 B2 9/2006 Romes et al. ..... 52/405.1
7,654,051 B2 * 2/2010 Pollack ..... E04B 1/74 52/302.1
7,739,844 B2 6/2010 Gharibeh et al. ..... 52/309.8
D646,559 S * 10/2011 Near ..... D8/384
8,230,655 B2 7/2012 Kallweit ..... 52/407.3
8,657,244 B2 * 2/2014 Sillik ..... E04D 13/1625 248/217.3
8,955,280 B2 * 2/2015 Fabis ..... E04F 13/21 411/384
9,631,360 B2 * 4/2017 Ter-Borch ..... E04F 13/0803
2003/0070379 A1 4/2003 Worley ..... 52/506.05
2004/0050004 A1 3/2004 McCann ..... 52/404.2
2008/0245010 A1 * 10/2008 Pollack ..... E04B 1/74 52/404.3
2010/0276559 A1 * 11/2010 Sillik ..... E04B 1/7666 248/342
2011/0250035 A1 * 10/2011 Goldberg ..... E04B 2/707 411/366.1
2014/0075859 A1 * 3/2014 Harkins ..... F24S 20/66 52/169.11
2014/0245683 A1 * 9/2014 Fabis ..... E04F 13/21 52/309.4
2015/0300004 A1 10/2015 Ter-Borch ..... E04B 1/7637
2016/0273221 A1 9/2016 Ciuperca ..... E04C 2/296

* cited by examiner

FRAMED WALL INSULATION BACKING DEVICE, AND RELATED SYSTEMS AND METHODS

CROSS REFERENCE TO RELATED APPLICATION

This application claims benefit of U.S. Provisional Application Ser. No. 62/456,461 entitled, "Framed Wall Insulation Backing Device, and Related Systems and Methods" filed Feb. 8, 2017, the entire disclosure of which is incorporated herein by reference.

FIELD OF THE DISCLOSURE

The present disclosure is generally related to wall construction devices, systems, and methods, and more particularly is related to a framed wall insulation backing device, and related systems and methods.

BACKGROUND OF THE DISCLOSURE

Many buildings include concrete foundations which support the structure of the building and form a basement for the building. While some basements remain unfinished, with the concrete foundation acting as the floor and walls of the basement, many people desire to have a finished basement space to increase the overall square footage of the building. To finish a basement, it is necessary to cover over the concrete foundation walls with a more suitable wall covering, usually with a framed wall which is located just inside the concrete foundation wall. This framed wall may be constructed from metal or wood structures, including bottom and top plates and vertically-positioned studs which are spaced between the top and bottom plates across the distance of the concrete foundation wall. While the positioning of the framed wall can vary, it is common to leave a 1-2 inch gap between the backside of the framed wall and the inside of the concrete wall. This air gap or cavity provides an envelope between the framed wall and the concrete, which is needed to allow proper air circulation behind the framed wall, which in turn, helps prevent moisture build up or related problems, such as the formation of mold. After the framed wall is in place, wall covering materials, such as sheetrock, paint, and the like, are used to complete the basement walls.

In most basement finishing construction, it is necessary to insulate the framed wall to provide proper thermal conditions in the basement. Insulation commonly occurs in the form of batted fiberglass insulation which is hand-fitted between studs in the framed wall prior to installation of the wall cover materials. Usually, batts of insulation are sized to be friction fit within the stud cavities. For example, for a conventional 2"×4" framed wall, framed 16" on center, R13 fiberglass insulation batts having a width of approximately 15" are placed by workers into the 14.5" cavity between the studs. However, ensuring that the insulation batts are placed in the proper location can be challenging since the insulation batts are prone to being misplaced in the wall by hasty workers, or are prone to inadvertently being dislodged from their proper positions.

FIGS. 1A-1C are top view illustrations of a conventional finished basement wall, in accordance with the prior art. As shown in FIG. 1A, when the insulation batts 2 are placed within the framed wall 4, between the studs 6, it is common for the insulation batts 2 to be pushed too far inward towards the concrete wall 8. As a result, the insulation batts 2 have a tendency to fill the air gap 10 between the framed wall 4 and the concrete wall 8, which obstructs the air flow within the air gap 10. Moreover, this positioning of the insulation batts 2 significantly decreases the thermal value of the insulation. As shown in FIG. 1B, it is also common for insulation batts 2 to be installed improperly where the middle section of the insulation batts 2 extends beyond the front face of the studs 6. This situation can make it difficult to install a wall covering, such as drywall, since the protruding insulation prevents proper positioning of the drywall during installation, and over time it exerts a constant outward force on the drywall which can lead to fastener pull-through. When a wall covering isn't installed, such as in an unfinished basement, the protruding insulation batts 2 are susceptible to falling out over time.

Even when the insulation batts 2 are placed in the proper position initially, such as is shown in FIG. 1C, the wood studs 6 have a tendency to shrink over time due to loss of moisture. This shrinkage causes the distance between the studs 6 to enlarge and form gaps 5 on either side of the insulation batt 2. The presence of these gaps 5 decreases the frictional force of which the wood studs hold the insulation batts 2 in place. Furthermore, even when insulation batts 2 with a paper facing are used, with the paper facing affixed to the front edge of the studs 4, it is still inevitable that the insulation batt 2 will extend past the back of the framed wall 4 and into the air gap 10. All of these problems can decrease the quality of the wall's performance.

Thus, a heretofore unaddressed need exists in the industry to address the aforementioned deficiencies and inadequacies.

SUMMARY OF THE DISCLOSURE

Embodiments of the present disclosure provide an apparatus, system, and method for a framed wall insulation backing device. Briefly described, in architecture, one embodiment of a framed wall insulation backing apparatus, among others, can be implemented as follows. The framed wall insulation backing apparatus has a substantially planar backing panel. At least one attachment leg is extending from the backing panel, wherein the at least one attachment leg is positioned in a substantially perpendicular direction from a plane of the backing panel. At least one insulation-retention device is formed on the backing panel, wherein the at least one insulation-retention device is positionable to extend away from a planar face of the backing panel.

In another embodiment of the subject disclosure, a system for installing batted insulation is provided. In this regard, the system includes a concrete wall and a framed wall positioned a spaced distance from the concrete wall, wherein the framed wall has a plurality of vertically-positioned studs. A plurality of backing apparatuses are each affixed to at least one of the plurality of studs. Each of the plurality of backing apparatuses have a substantially planar backing panel, at least one attachment leg extending from the backing panel, wherein the at least one attachment leg is positioned in a substantially perpendicular direction from a plane of the backing panel, and at least one insulation-retention device formed on the backing panel, wherein the at least one insulation-retention device is positionable to extend away from a planar face of the backing panel. A fastener is connected between the at least one attachment leg of each of the plurality of backing apparatuses and at least one of the studs. A batt of insulation is positioned abutting at least a portion of the plurality of backing apparatuses in a location between at least two of the studs, wherein the batt of insulation is retained in a stationary location with the at least one insulation-retention device of at least one of the plurality of backing apparatuses.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1A:
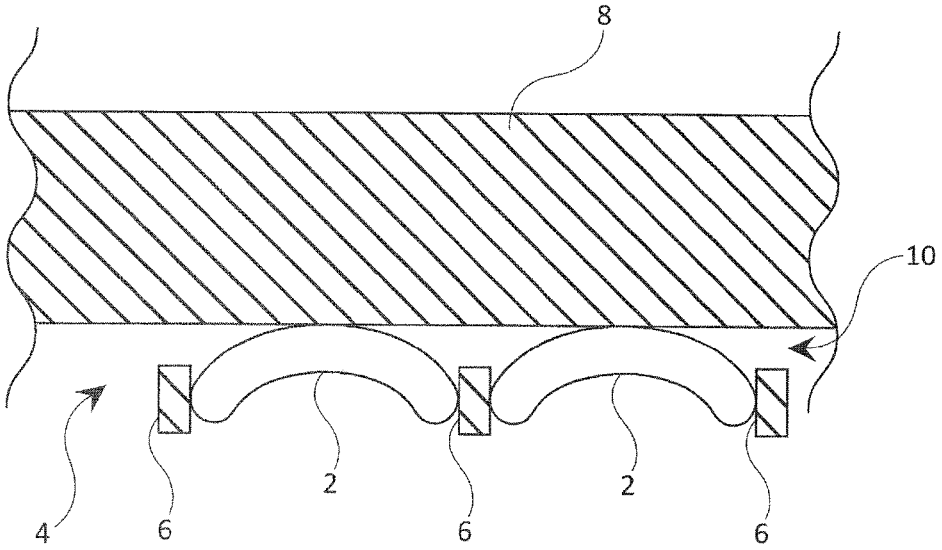
FIG. 1A Prior Art
FIGS. 1A-1C are top view illustrations of a conventional finished basement wall, in accordance with the prior art.
Figure 1B:
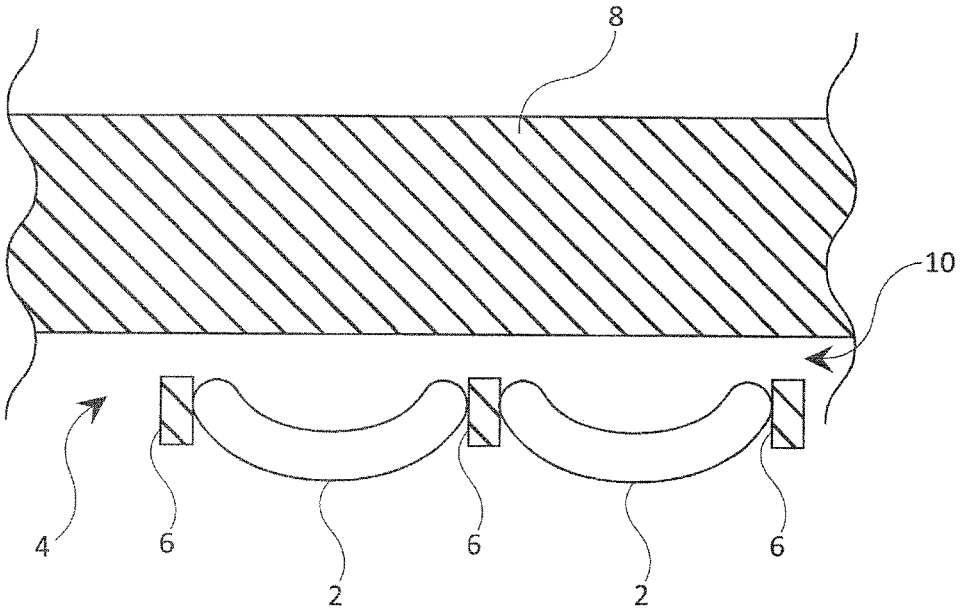
FIG. 1B Prior Art
Figure 1C:
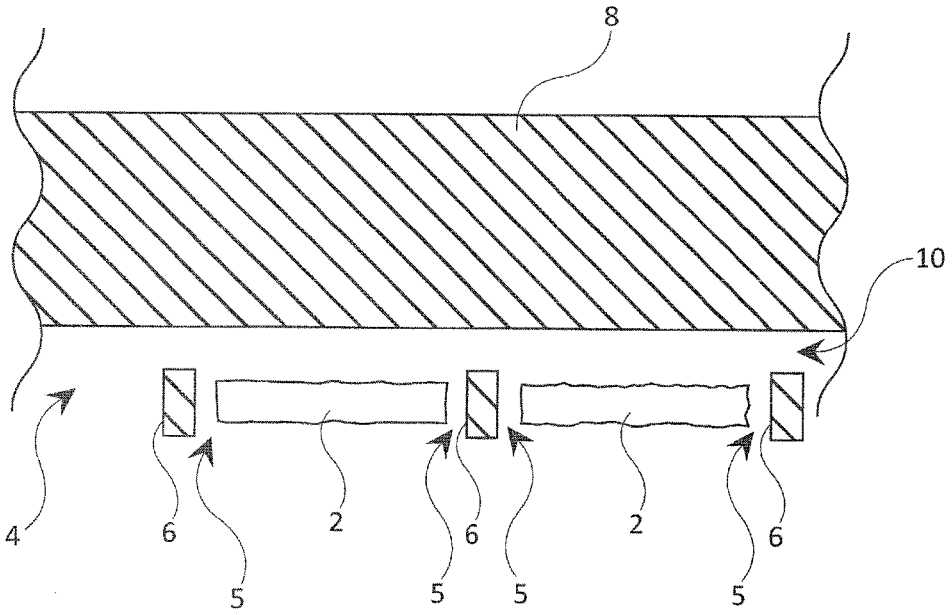
FIG. 1C Prior Art
Figure 2A:
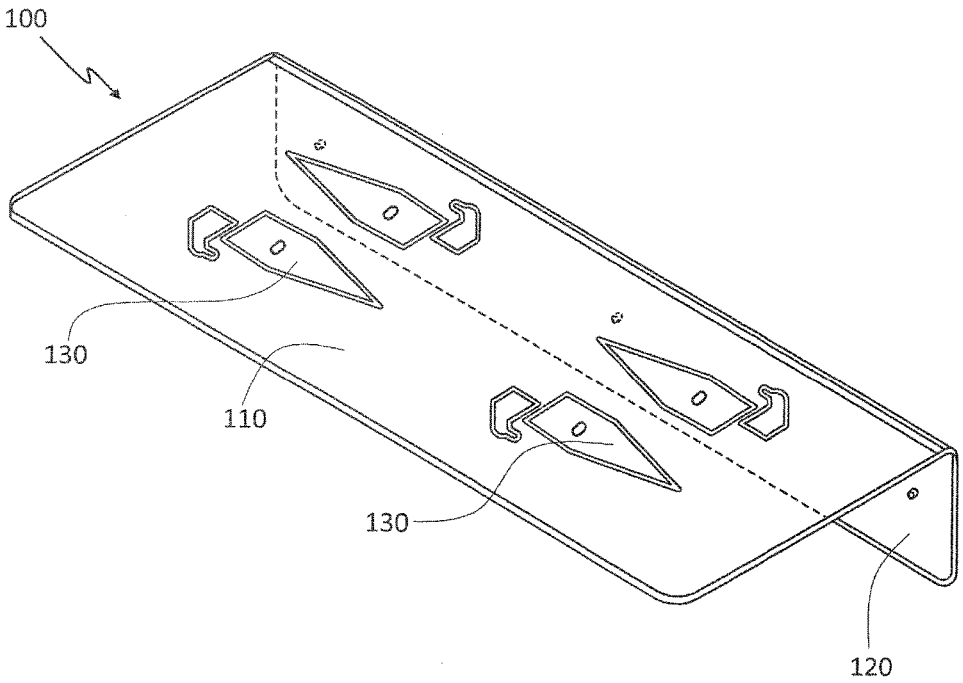
FIG. 2A is an isometric view illustration of a framed wall insulation backing apparatus, in accordance with a first exemplary embodiment of the present disclosure.
Figure 2B:
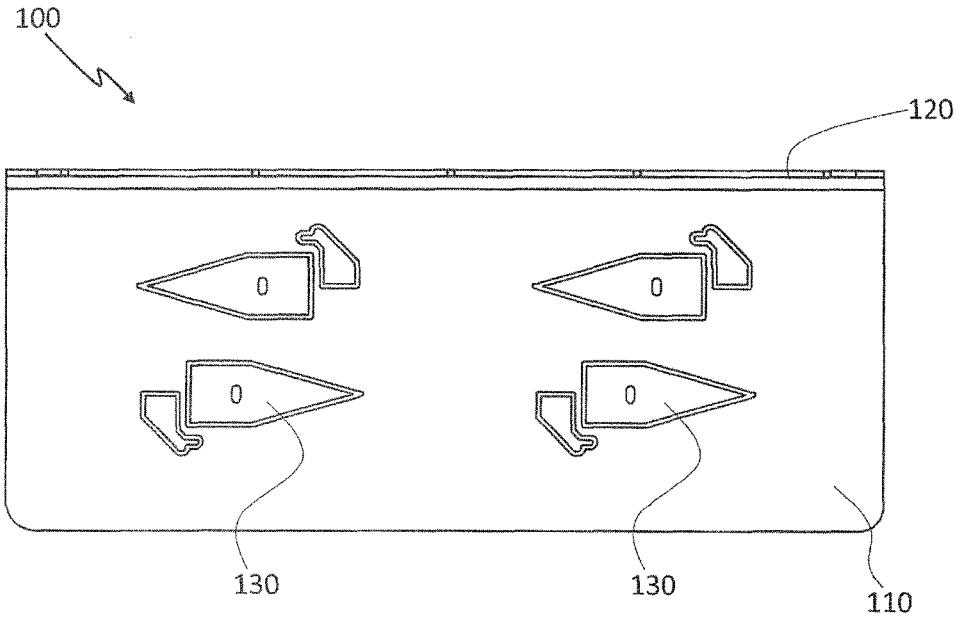
FIG. 2B is a front view illustration of the framed wall insulation backing apparatus of FIG. 2A, in accordance with the first exemplary embodiment of the present disclosure.

FIG. 2A is an isometric view illustration of a framed wall insulation backing apparatus 100, in accordance with a first exemplary embodiment of the present disclosure. FIG. 2B is a front view illustration of the framed wall insulation backing apparatus 100 of FIG. 2A, in accordance with the first exemplary embodiment of the present disclosure. The framed wall insulation backing apparatus 100, which may be referred to as 'apparatus 100' includes a substantially planar backing panel 110. An attachment leg 120 extends from the backing panel 110 and is positioned in a substantially perpendicular direction from a plane of the backing panel 110. The leg 120 may be used to attach the apparatus 100 to a stud within a framed wall. At least one insulation-retention device 130 is formed on the backing panel 110. The at least one insulation-retention device 130 is positionable to extend away from a planar face of the backing panel 110.

As is shown in FIGS. 2A-2B, the backing panel 110 may be a substantially planar structure where the attachment leg 120 extends from an edge of the backing panel 110 in a substantially perpendicular angle. In some situations, the attachment leg 120 may extend from the backing panel 110 in a location other than along its edge. When the attachment leg 120 is positioned abutting a side edge of a stud in a framed wall, the backing panel 110 may be positioned extending from the stud into the cavity between two framed studs. The insulation-retention devices 130 are generally spiked, barbed, or hooked structures which are formed on the backing panel 110 and are positioned to frictionally contact or engage an insulation batt when it is pushed in the framed wall cavity and contacts the apparatus 100. The insulation-retention devices may be constructed or formed with various shapes and using a variety of different techniques, as discussed in greater detail relative to other figures of this disclosure.

The apparatus 100 is used to retain insulation properly within the cavity of a wall between studs of the wall, and can solve the deficiencies discussed in the Background. Specifically, the apparatus 100 may be mounted to the side of a stud of the wall with one side of the backing panel 110 facing the batted insulation within the wall, commonly towards an interior of a room formed by the wall. With the apparatus 100 secured in place, the insulation-retention devices 130 may be used to hold the insulation batts as they are positioned between the framed studs. Specifically, the insulation-retention devices may provide a frictional contact to the insulation batts, such as by spiking into the insulation batts, which secures the insulation batts in both the desired vertical position and retain the edges of the insulation batts on opposing sides of the stud cavity. In this way, the insulation batt can be retained in the proper position to provide the maximum thermal value within the wall cavity, even when the materials of the wall settle, such as shrinking of wooden studs which causes an enlargement of the cavity in the wall between the studs. The insulation batts commonly are formed from fiberglass insulative materials, but any batted insulation product may also be used.

The apparatuses 100 may be manufactured from any suitable materials, such as plastic, metal, or another material, or combination thereof. Preferably, the apparatus 100 will be constructed from material(s) which allow it to be manufactured in an inexpensive manner, yet ensure that it is durable. For example, manufacturing may include injection molding, extrusion, stamping, or any combination thereof. The material from which the apparatus 100 is constructed may include any type of construction material, such as plastics, metals, fiberglass or resin-formed materials, or any combination thereof. In one example, it may be preferable for the apparatus 100 to be manufactured from a material that can be cut with a razor knife, such that a worker can trim the length of the apparatus 100 to the desired length. In this example, the size of the apparatus 100 from back to front (thickness) may be substantially thin, such as 0.25 inches. In other examples, such as shown in FIGS. 2A-2B, the apparatus 100 may have a predetermined length, such as 16 inches, whereby a user can install one or more apparatus 100 against a framed stud.

While the insulation-retention devices 130 are formed on the backing panel 110, they may be formed with a permanent position or location, or they may be formed with an initial position or location which can be modified by the user during installation. For example, the insulation-retention devices 130 may be formed as spikes, barbs, or hooks which are unitarily molded onto the face of the backing panel 110. In this example, the insulation-retention devices 130 will generally always have a positioned which extends from the front planar face of the backing panel 110.

Figure 3A:
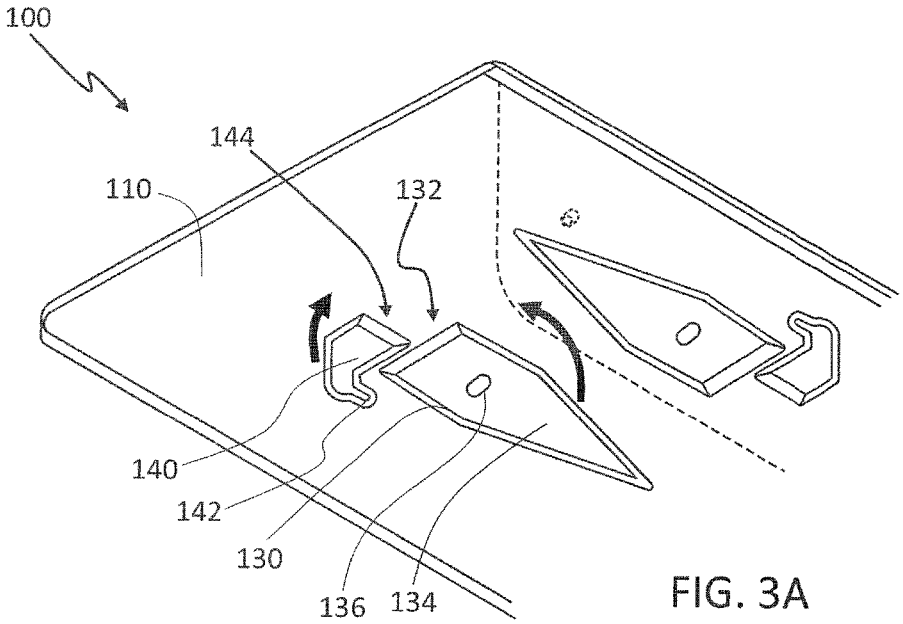
FIG. 3A is an enlarged isometric view illustration of the framed wall insulation backing apparatus of FIG. 2A, in accordance with the first exemplary embodiment of the present disclosure.
Figure 3C:
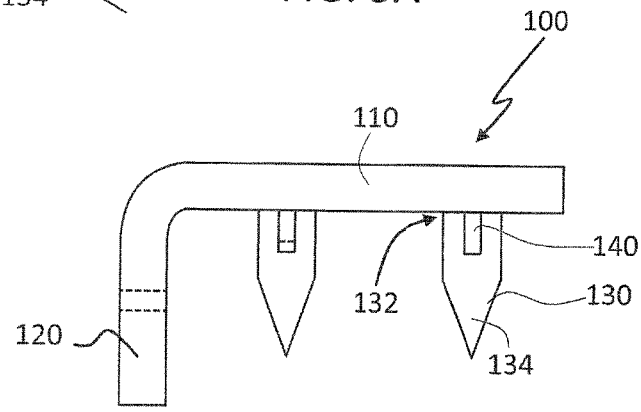
FIG. 3C is a side view illustration of the framed wall insulation backing apparatus of FIG. 2A, in accordance with the first exemplary embodiment of the present disclosure.
Figure 3B:
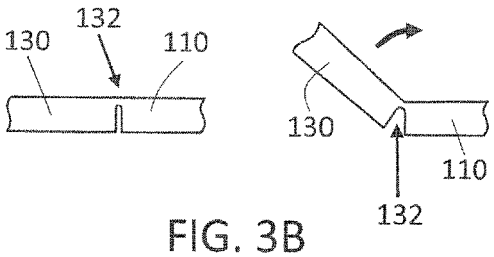
FIG. 3B is a side view illustration of a living hinge used with the framed wall insulation backing apparatus of FIG. 2A, in accordance with the first exemplary embodiment of the present disclosure.

However, in another example, it may be desirable to form the apparatus 100 with the insulation-retention devices 130 not extending from the planar face of the backing panel 110 initially, but where the user can manipulate the insulation-retention devices 130 to position them in the desired location, e.g., generally extending from the front face of the backing panel 110 in a substantially perpendicular angle. FIG. 3A is an enlarged isometric view illustration of the framed wall insulation backing apparatus of FIG. 2A, in accordance with the first exemplary embodiment of the present disclosure. FIG. 3B is a side view illustration of a living hinge used with the framed wall insulation backing apparatus of FIG. 2A, in accordance with the first exemplary embodiment of the present disclosure. FIG. 3C is a side view illustration of the framed wall insulation backing apparatus of FIG. 2A, in accordance with the first exemplary embodiment of the present disclosure. Referring to FIGS. 3A-3C, in this example, the insulation-retention devices 130 may be formed with a hinged attachment to the backing panel 110 such that the insulation-retention devices 130 can be moved from a substantially co-planar position with the backing panel 110, as is shown in FIG. 3A, to a position where the insulation-retention devices 130 are positioned extending from the front planar face, as shown in FIG. 3C.

In the example shown in FIGS. 3A-3C, the apparatus 100 may utilize a hinged connection 132 between the non-pointed end of the insulation-retention device 130 and the backing panel 110. The hinged connection 132 may be created during manufacture as a living hinge, as shown in FIG. 3B, where the hinged connection 132 is formed as a thin, flexible pivot-capable structure, e.g., flexure bearing, made from the same material as the two rigid pieces it connects, e.g., the backing panel 110 and the insulation-retention device 130. As shown in FIG. 3A, the insulation-retention device 130 can flex at the hinged connection 132 point to allow it to move out of a co-planar position with the backing panel 110. The hinged connection 132 formed as a living hinge can be formed during a manufacturing process where the apparatus 100 is molded or stamped with a decreased material at the hinged connection 132.

As is shown in FIGS. 3A and 3C, the insulation-retention device 130 may include a spiked member 134, which is the structure that is hingedly attached to the backing panel 110, and a fastener member 140, also hingedly attached to the backing panel 110, where the fastener member 140 is connectable to the spiked member 134 to retain the spiked member 134 in a position extending beyond the planar face of the backing panel 110. The fastener member 140 is connectable to the spiked member 134 by engagement between a protruding arm 142 of the fastener member 140 with an aperture 136 of the spiked member 134. Specifically, when each of the spiked member 134 and the fastener member 140 are pivoted away from a coplanar position with the backing panel 110, as indicated by the block arrows in FIG. 3A, the movement of which is facilitated by the hinged connections 132, 144 for both the spiked member 134 and the fastener member 140, respectively, the protruding arm 142 of the fastener member 140 may be aligned with the aperture 136 of the spiked member 134, at which point the spiked member 134 can be moved towards the fastener member 140 to allow engagement of the protruding arm 142 and the aperture 136. Due to the natural bias within the hinged connection 132 when formed as a living hinge, a biased connection may be formed between the fastener member 140 and the spiked member 134, whereby at least one of the fastener member 140 and the spiked member 134 exert a biased force on the other. Commonly, both the fastener member 140 and the spiked member 134 will exert biased forces on the other.

Figure 4C:
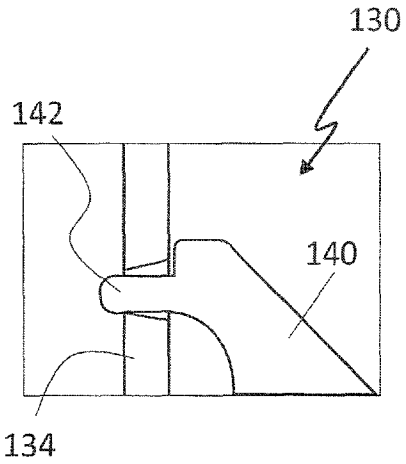
FIGS. 4A-4C are detailed view illustrations of engagement between a spiked member and a fastener member of the framed wall insulation backing apparatus of FIG. 2A, in accordance with the first exemplary embodiment of the present disclosure.
Figure 4B:
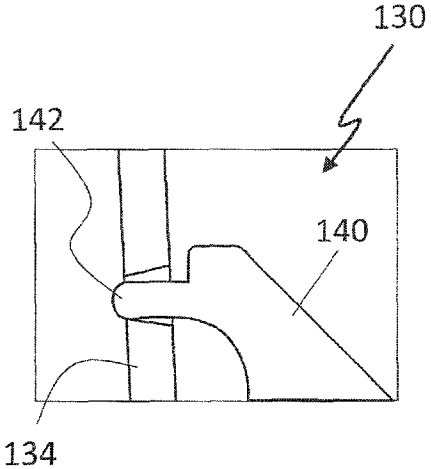
Figure 4A:
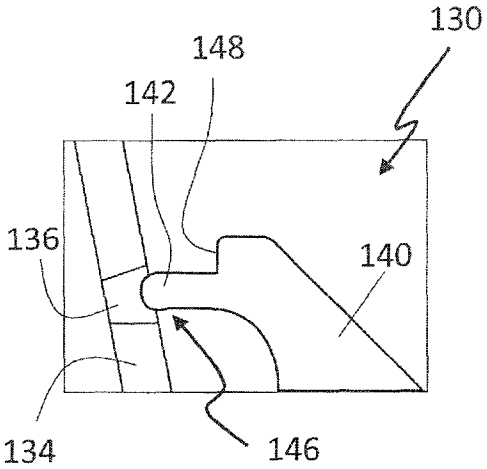

FIGS. 4A-4C are detailed view illustrations of engagement between a spiked member 134 and a fastener member 140 of the framed wall insulation backing apparatus 100 of FIGS. 2A, 3B, and 3C, in accordance with the first exemplary embodiment of the present disclosure. As shown in FIG. 4A, the protruding arm 142 may be positioned aligned with the aperture 136 and pushed through the aperture 136 until it achieves a position as shown in FIG. 4B. Here, the distal end of the protruding arm 142 may have a raised edge 146 which catches the rear of the aperture 136. When the protruding arm 142 achieves a position as shown in FIG. 4C with the raised edge 146 fully caught with the rear of the aperture 136, the raised edge 146 may prevent inadvertent disengagement between the protruding arm 142 and the aperture 136 of the spiked member 134. As can be seen in the figures, the aperture 136 may be an angled aperture 136 having angled sidewalls which direct the distal end of the protruding arm 142 towards the opening of the aperture 136. Additionally, the fastener member 140 may include a stopping face 148. When the protruding arm 142 is moved through the aperture 136, the protruding arm 142 may be stopped by contact between the face of the spiked member 134 and the stopping face 148 of the fastener member 140.

Figure 5:
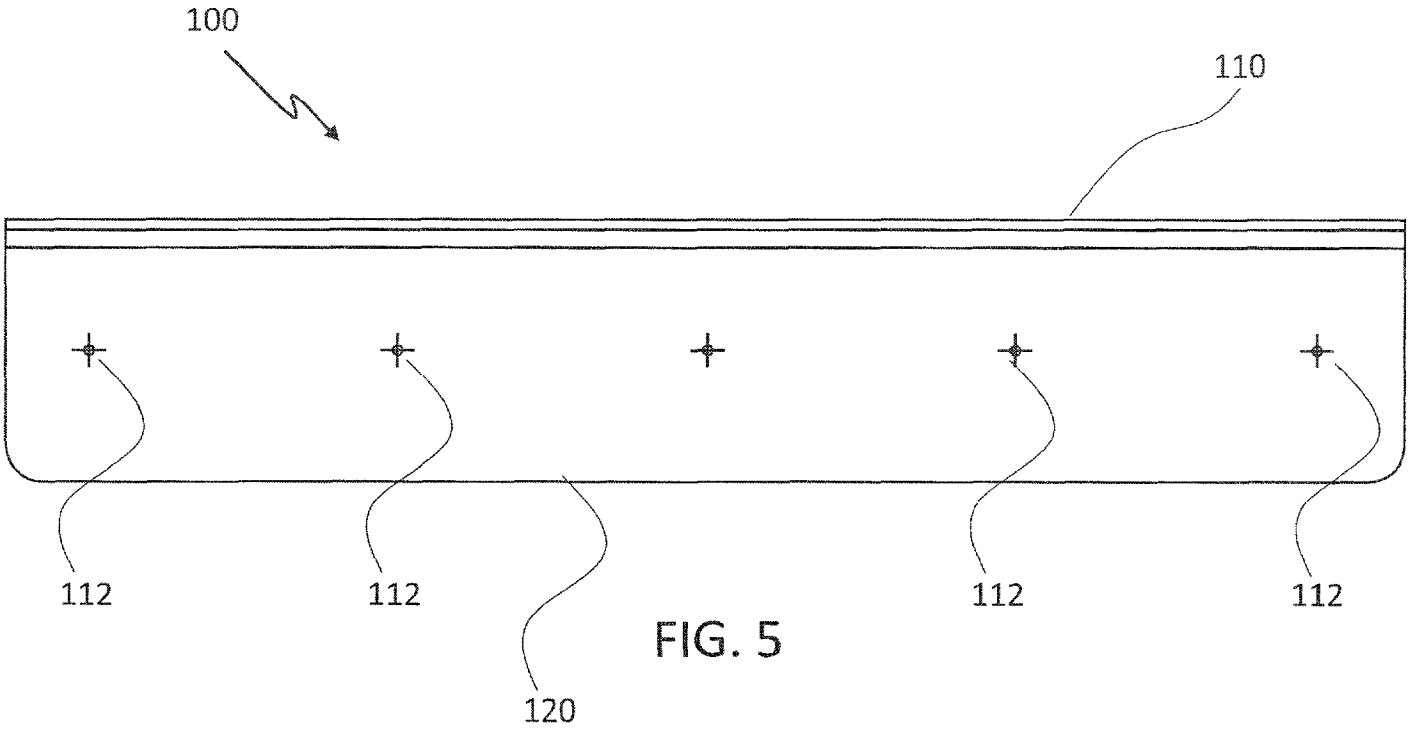
FIG. 5 is a side view illustration of the attachment leg of the framed wall insulation backing apparatus of FIG. 2A, in accordance with the first exemplary embodiment of the present disclosure.

FIG. 5 is a side view illustration of the attachment leg 120 of the framed wall insulation backing apparatus of FIG. 2A, in accordance with the first exemplary embodiment of the present disclosure. As shown, the attachment leg 120 may include a plurality of fastener holes 112 positioned within the at least one attachment leg 120, whereby a fastener, such as a nail, a screw, a staple, or another fastener, is drivable through at least one of the plurality of fastener holes 112 and into a framing stud. In one example, the fastener holes 112 are ⅛ inch holes, however in other examples, the fastener holes 112 may include non-aperture cuts in the material which allow a fastener to be driven through the attachment leg 120 without cracking the material.

While the dimensions may vary, the dimensions of the apparatus 100 in one example may be: length of the attachment leg 120 and the backing panel 110: 16 inches; width of the backing panel 110: 6.5 inches; width of the attachment leg 120: 3.0 inches; thickness of the attachment leg 120 and the backing panel 110: ⅛ inch.

Figure 6:
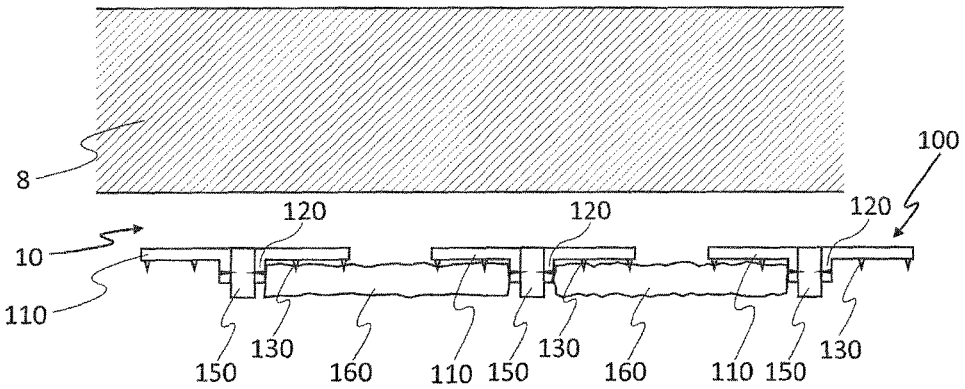
FIG. 6 is a top view illustration of a plurality of framed wall insulation backing apparatus of FIG. 2A in use with a system for installing batted insulation, in accordance with the first exemplary embodiment of the present disclosure.
Figure 7:
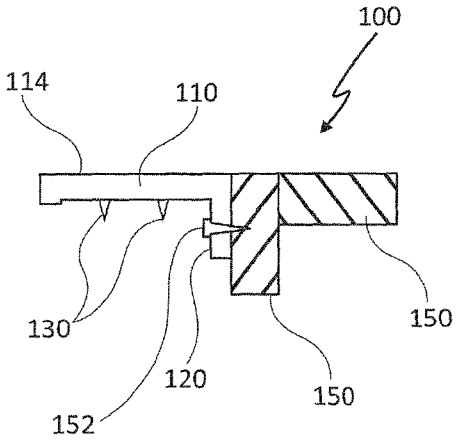
FIG. 7 is a top view illustration of the framed wall insulation backing apparatus of FIG. 2A in an installed position within a framed wall, in accordance with the first exemplary embodiment of the present disclosure.

FIG. 6 is a top view illustration of a plurality of framed wall insulation backing apparatus 100 of FIG. 2A in use with a system for installing batted insulation, in accordance with the first exemplary embodiment of the present disclosure. FIG. 7 is a top view illustration of the framed wall insulation backing apparatus 100 of FIG. 2A in an installed position within a framed wall, in accordance with the first exemplary embodiment of the present disclosure. These figures illustrate the apparatus 100 in use with a stud 150 of a wall with the side of the attachment leg 110 being positioned against a face of the stud 150. In this position, the apparatus 100 may be secured to the stud 150 with a fastener 152, such as a nail or a screw. In one example, a flat-head nail (roofing nail) may be used as the fastener 152. In another example, the apparatus 100 may be provided with the fastener holes 112 (FIG. 5) for easy fastener 152 installation and/or the fastener 152 may be manufactured into the leg 120 of the apparatus 100 for convenient installation. The apparatus 100 may remain stationary against the stud 150 such that it is capable of being held in a substantially fixed position within the wall. The positioning shown in FIG. 6 may be when the apparatus 100 is used in a straight portion of the wall. In FIG. 7, the apparatus 100 is retained in a corner position, which may occur when the apparatus 100 is used at a junction between two walls. Here, two or more studs 150 may be positioned together with the apparatus 100 positioned in the corner formed therebetween. Specifically, the leg 120 of the apparatus 100 may be positioned abutting a face of one stud 150. A fastener 152 can be used to retain the apparatus 100 to either of the corner studs 150.

As is shown in FIG. 6, the apparatus 100 is used with a framed wall having a plurality of studs 150 which are positioned proximate to a concrete wall 8, such as would be seen in basement wall. A gap 10 is positioned between the studs 150 of the wall and the concrete wall 8. The apparatus 100 can be positioned affixed to each of the studs 150, as described relative to FIG. 7, and the insulation batts 160 can be positioned between two of the apparatuses 100, such that the insulation batt 160 extends from the left side of one apparatus 100 to the right side of another apparatus 100. The insulation-retention devices 130 can retain the insulation batts 160 in place between the studs 150 such that the insulation batts 160 can substantially fill the wall cavity between the studs 150. When the insulation batt 160 is initially installed into the wall cavity, the backing panel 110 of the apparatus 100 can prevent the insulation batt 160 from being pushed too far into the wall cavity. In other words, the backing panel 110 can prevent the insulation batts 160 from entering the gap 10 between the studs 160 and the concrete wall 8, which allows the insulation batt 160 to provide the full thermal benefit of the insulation. Additionally, the frictional engagement between the insulation-retention devices 130 and the insulation batt 160 may prevent it from falling out of the wall towards the front side, and may prevent gaps between the studs 150 and the insulation batt 160 due to shrinkage of the studs 150.

Figure 8:
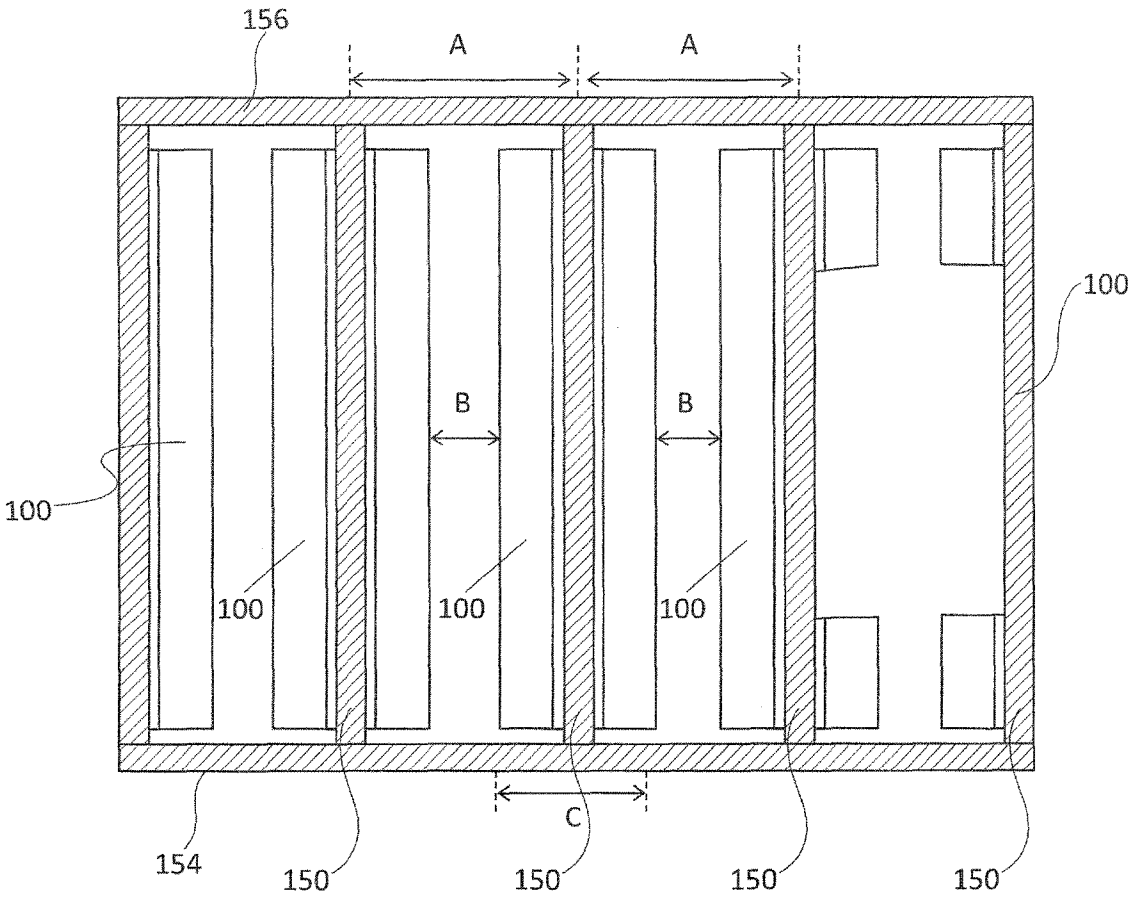
FIG. 8 is a side view illustration of a system for installing batted insulation using the framed wall insulation backing apparatus, in accordance with the first exemplary embodiment of the present disclosure.

FIG. 8 is a side view illustration of a system for installing batted insulation using the framed wall insulation backing apparatus, in accordance with the first exemplary embodiment of the present disclosure. In particular, FIG. 8 illustrates two examples of the sizing of the apparatus 100 relative to the wall. In one example, shown in the right-hand stud bay of the illustration, the apparatus 100 as described relative to FIGS. 2A-2B may be positioned within the stud bay at various positions, such as near the top and bottom of the bay. Any position of the apparatus 100 within the stud bay along the length of the stud 150 may be capable of being used. In contrast, in another example, the apparatus 100, having a significantly greater length, may be positioned along a length of the stud 150 that allows the apparatus 100 to extend from a bottom area of the stud 150, proximate to a footer 154, to a top area of the stud 150, proximate to a header 156. This example is illustrated in the three stud bays on the left of the illustration. While the specific length of the apparatus 100 may vary, the apparatus 100 may be used along a substantial portion of the length of the stud 150 to provide backing to an insulation batt (not shown) for a sufficient portion of the wall. While a few inches on the top and/or bottom of the wall, or in other places in the wall, may not have the backing support of the apparatus 100, the size of the apparatus 100 can be user-selected based on the intended results of backing an insulation batt in the wall. In one example, a user can simply use a razor knife to cut the apparatus 100 to the appropriate length. In another example, the apparatus 100 may be manufactured to pre-determined, universal sizes.

Additionally, FIG. 8 may depict lateral spacing of the apparatus 100 within a framed wall. Commonly, the studs 150 within the wall will be spaced a distance A from one another, relative to the center of the studs 150, where distance A is 16 inches. Other spacing is also envisioned. When 16-inch on center spacing is used, the space between the left side of one stud 150 and the right side of an abutting stud 150 is commonly 14.5 inches. It is desired that the width of the apparatus 100 extends sufficient enough between the studs 150 to provide sufficient backing of the insulation batts. In one example, the terminating edge of the apparatus 100 may extend anywhere from 1 inch to 7.25 inches from the side edge of the studs 150, preferably 6 inches from the edge of the studs 150, such that the spacing between two terminating edges of the apparatus 100, as measured by distance B, is anywhere from 0 inches to 12.5 inches, preferably 1-2 inches. To achieve this sizing, the overall width of the apparatus 100, as measured by distance C, may be anywhere from 3.5 inches to 14.5 inches. While these exemplary sizes of the apparatus 100 are disclosed relative to framed walls with studs 150 being 16 inches on center, different spacing and/or overlapping of portions of the apparatus 100 can be used for other framed wall sizes.

Figure 9:
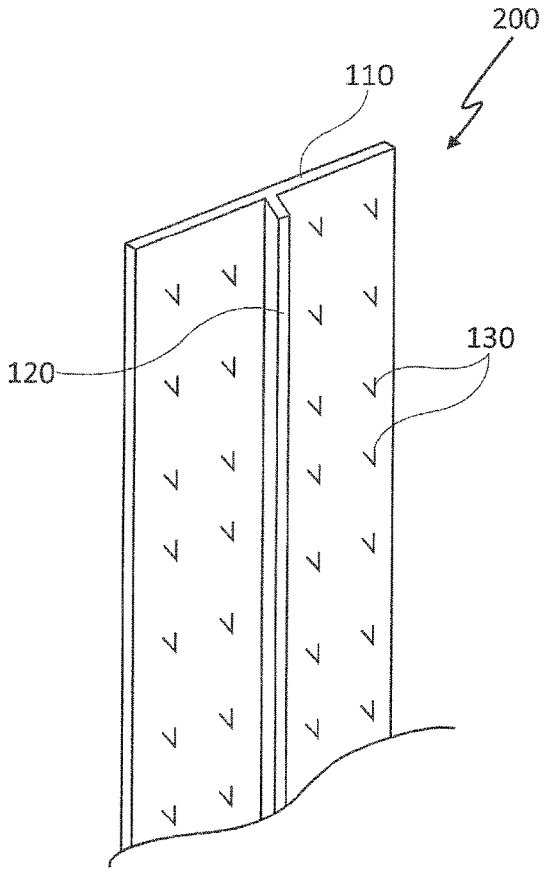
FIG. 9 is an isometric view illustration of a framed wall insulation backing apparatus, in accordance with a second exemplary embodiment of the present disclosure.
Figure 10:
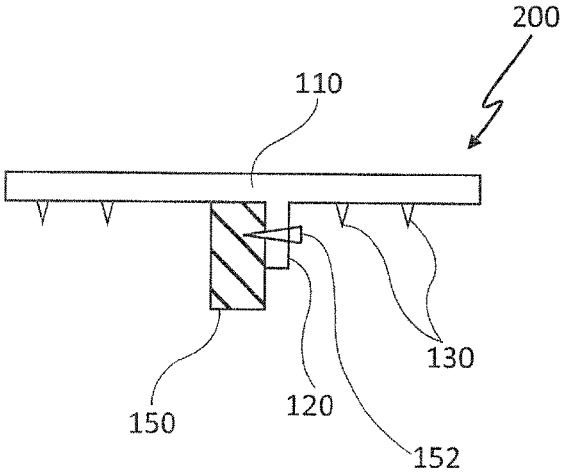
FIG. 10 is a top view illustration of a framed wall insulation backing apparatus in an installed position within a framed wall, in accordance with the second exemplary embodiment of the present disclosure.
Figure 11A:
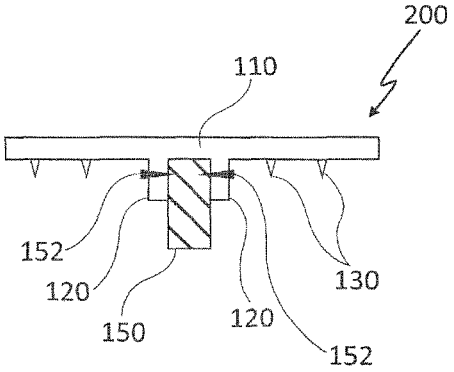
FIGS. 11A-11C are top view illustrations of installation techniques of the framed wall insulation backing apparatus, in accordance with the second exemplary embodiment of the present disclosure.
Figure 11B:
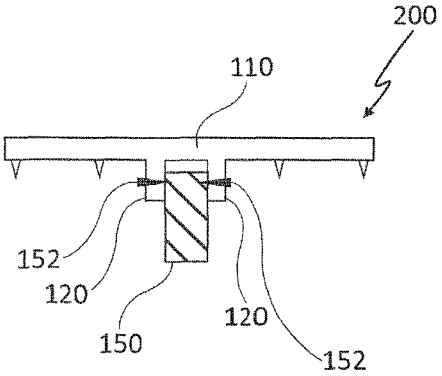
Figure 11C:
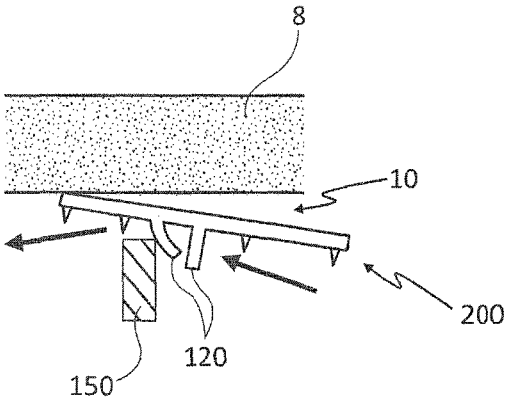

FIG. 9 is an isometric view illustration of a framed wall insulation backing apparatus 200, in accordance with a second exemplary embodiment of the present disclosure. FIG. 10 is a top view illustration of a framed wall insulation backing apparatus 200 in an installed position within a framed wall, in accordance with the second exemplary embodiment of the present disclosure. FIGS. 11A-11C are top view illustrations of installation techniques of the framed wall insulation backing apparatus 200, in accordance with the second exemplary embodiment of the present disclosure.

The apparatus 200 of FIGS. 9-11C may be substantially similar to that disclosed in FIGS. 2A-8, but it may include an extended backing panel 110 which is sized to position the insulation-retention devices 130 on both sides of a stud 150. As shown, the apparatus 100 is positioned against a stud 150 within a wall, with the first side of the backing panel 110 being positioned against a first face of the stud 150, and a side of the leg 120 being positioned against a second face of the stud 150. In this position, the apparatus 100 may be secured to the stud 150 with a fastener 152, such as a nail or a screw. In one example, a flat-head nail (roofing nail) may be used as the fastener 152. In another example, the apparatus 100 may be pre-drilled for easy fastener 152 installation and/or the fastener 152 may be manufactured into the leg 120 of the apparatus 100 for convenient installation. The apparatus 100 may remain stationary against the stud 150 such that it is capable of being held in a substantially fixed position within the wall. The positioning shown in FIG. 10 may be when the apparatus 100 is used in a straight portion of the wall.

FIGS. 11A-11C are top view illustrations of the framed wall insulation backing apparatus 200, in accordance with the second exemplary embodiment of the present disclosure. As shown in FIG. 11A, the apparatus 200 may include two or more legs 120, as opposed to the design of FIGS. 2A-B which has only a single leg 120. Having two legs 120 extending from the backing panel 110 may allow for the apparatus 200 to be secured to both sides of a stud 150 with fasteners 152, or it may give the installer the ability to choose which side of the stud 150 to secure the fastener 152. In some situations, it may be required that the apparatus 200 be secured to the stud 150 along a single side, whereas in other situations, it may be desirable for the apparatus 200 to be secured to both sides of a stud 150. The apparatus 200 can be sized in smaller lengths, such as 16 inches, or the apparatus 200 can have longed lengths that are capable of being cut to the desired size with a utility knife or similar implement. Again, an installer can cut the apparatus 200 used for a straight run on the wall into a corner piece. Additionally, in another example, when a wall cavity is far less than the normal 16 inches on center, such as when nearing a corner, the backing panel 110 of the apparatus 200 can be sliced on the exterior of one of the legs 120, thereby leaving a structure with two legs 120 and a backing panel 110 that extends to one side thereof.

One exemplary situation where securing the apparatus 200 to both sides of a stud 150 may be advantageous is illustrated in FIG. 11B, where the stud 150 is twisted, bowed, or otherwise not straight. Wood studs 150 are often twisted due to the natural curvature of the wood, which may occur based on a moisture content of the wood. When a stud 150 is twisted, the back edge of the stud 150 may not be aligned with the run of the wall, which can cause articles secured against the back edge of the stud 150 to be misaligned with the wall. Securing the apparatus 100 on both sides allows the installer to position the apparatus 200 in an aligned position to the wall, and then secure the apparatus 200 with fasteners 152 through the legs 120. This allows the installer to effectively take the twist out of the stud 150 and have the apparatus be straight or parallel with the back of the wall regardless if you have some twisted studs.

Another feature of the apparatus 200 may be the use of differently-functioning materials to form different parts of the apparatus 200. For example, as shown in FIG. 11C, in some situations the gap 10 between the concrete wall 8 and the framed wall may be smaller, such that it is difficult to fit the apparatus 200 within the gap 10 during installation. To solve this problem, the leg or legs 120 of the apparatus 200 may be slightly flexible, such that they can bend or be biased to the side while the apparatus 200 is positioned behind the stud 150. As shown, when the apparatus 200 is moved in the direction of the arrows in FIG. 11C, the first leg 120 may bend inwards towards the second leg 120 until the first leg 120 is positioned past the stud 150, at which point it moves back to its natural position. The apparatus 200 can then be pulled forward, such that the stud 150 seats between the legs 120. While being flexible, the legs 120 may also be rigid enough to provide firm attachment points for securing the apparatus 200 to the stud 150 with a fastener. It is noted that the apparatus 200 of FIGS. 11A-11C may include any of the features, structures, or functions disclosed in this disclosure, all of which are considered within the scope of the present disclosure.

It should be emphasized that the above-described embodiments of the present disclosure, particularly, any "preferred" embodiments, are merely possible examples of implementations, merely set forth for a clear understanding of the principles of the disclosure. Many variations and modifications may be made to the above-described embodiment(s) of the disclosure without departing substantially from the spirit and principles of the disclosure. All such modifications and variations are intended to be included herein within the scope of this disclosure and the present disclosure and protected by the following claims.

What is claimed is:

1. A framed wall insulation backing apparatus comprising:

a substantially planar backing panel;

at least one attachment leg extending from the backing panel, wherein the at least one attachment leg is positioned in a substantially perpendicular direction from a plane of the backing panel; and at least one insulation-retention device formed on the backing panel, the at least one insulation-retention device having a spiked member hingedly attached to the backing panel and a fastener member hingedly attached to the backing panel, the spiked member and the fastener member located proximate to one another, wherein the fastener member is configured to contact the spiked member to retain the spiked member in a position extending beyond a planar face of the backing panel.

2. The framed wall insulation backing apparatus of claim 1, wherein at least one of the spiked member and the fastener member are hingedly attached to the backing panel with a living hinge.

3. The framed wall insulation backing apparatus of claim 1, wherein the at least one insulation-retention device further comprises at least one of: a pointed spike, a barbed spike, and a hooked spike.

4. The framed wall insulation backing apparatus of claim 1, wherein the at least one insulation-retention device further comprises a plurality of insulation-retention devices spaced across the backing panel.

5. The framed wall insulation backing apparatus of claim 1, further comprising a plurality of fastener holes positioned within the at least one attachment leg, whereby a fastener is drivable through at least one of the plurality of fastener holes.

6. The framed wall insulation backing apparatus of claim 1, wherein the at least one insulation-retention device is movable between at least a first position where the at least one insulation-retention device is substantially coplanar with the backing panel, and a second position where the at least one insulation-retention device extends beyond the planar face of the backing panel.

7. The framed wall insulation backing apparatus of claim 6, wherein the second position further comprises the at least one insulation-retention device positioned in a substantially perpendicular direction from a plane of the backing panel.

8. The framed wall insulation backing apparatus of claim 1, wherein the spiked member has an aperture formed therein, wherein the fastener member is connectable to the spiked member by being positioned at least partially through the aperture.

9. The framed wall insulation backing apparatus of claim 8, wherein the aperture further comprises an angled aperture, the angled aperture having angled sidewalls.

10. The framed wall insulation backing apparatus of claim 8, wherein the fastener member further comprises a protruding arm and a stopping face, wherein the protruding arm is movable through the aperture until a contact between the spiked member and the stopping face.

11. A framed wall insulation backing apparatus comprising:

a substantially planar backing panel comprised of a plastic material;

at least one attachment leg extending from the backing panel, wherein the at least one attachment leg is positioned in a substantially perpendicular direction from a plane of the backing panel; and at least one insulation-retention device formed on the backing panel and comprised of the plastic material, the at least one insulation-retention device being hingedly attached to the backing panel with a living hinge having a thickness, the living hinge formed from a decreased quantity of the plastic material in a location between the substantially planar backing panel and the at least one insulation-retention device such that the thickness of the living hinge is less than respective thicknesses of the substantially planar backing panel and the at least one insulation-retention device, wherein the at least one insulation-retention device is hingedly movable between co-planar and perpendicular positions relative to the substantially planar backing panel.

12. The framed wall insulation backing apparatus of claim 11, wherein the at least one insulation-retention device further comprises:

a spiked member hingedly attached to the backing panel; and a fastener member hingedly attached to the backing panel, wherein the fastener member is connectable to the spiked member to retain the spiked member in a position extending beyond the planar face of the backing panel.

13. The framed wall insulation backing apparatus of claim 12, wherein the fastener member being connectable to the spiked member further comprises a biased connection, whereby at least one of the fastener member and the spiked member exert a biased force on the other.

14. The framed wall insulation backing apparatus of claim 12, wherein the spiked member has an aperture formed therein, wherein the fastener member is connectable to the spiked member by being positioned at least partially through the aperture.

15. The framed wall insulation backing apparatus of claim 14, wherein the aperture further comprises an angled aperture, the angled aperture having angled sidewalls.

16. The framed wall insulation backing apparatus of claim 14, wherein the fastener member further comprises a protruding arm and a stopping face, wherein the protruding arm is movable through the aperture until a contact between the spiked member and the stopping face.

17. A framed wall insulation backing apparatus comprising:

a substantially planar backing panel;

at least one attachment leg extending from the backing panel, wherein the at least one attachment leg is positioned in a substantially perpendicular direction from a plane of the backing panel; and at least one insulation-retention device formed on the backing panel, wherein the at least one insulation-retention device is positionable to extend away from a planar face of the backing panel, wherein the at least one insulation-retention device further comprises:

a spiked member hingedly attached to the backing panel and a fastener member hingedly attached to the backing panel, wherein the fastener member is connectable to the spiked member to retain the spiked member in a position extending beyond the planar face of the backing panel wherein the at least one of the spiked member and the fastener member are hingedly attached to the backing panel with a living hinge and wherein the fastener member being connectable to the spiked member further comprises a biased connection, whereby at least one of the fastener member and the spiked member exert a biased force on the other.

* * * * *